US007288049B2

(12) United States Patent
Stebler, Jr.

(10) Patent No.: US 7,288,049 B2
(45) Date of Patent: Oct. 30, 2007

(54) TEAM TREKKING DEVICE AND METHODS OF USING SAME

(76) Inventor: Philip F. Stebler, Jr., 201 St. Leonard's La., Cranberry Township, PA (US) 16066

( * ) Notice: Subject to any disclaimer, the term of this patent is extended or adjusted under 35 U.S.C. 154(b) by 5 days.

(21) Appl. No.: 11/216,804

(22) Filed: Aug. 31, 2005

(65) Prior Publication Data

US 2007/0049468 A1 Mar. 1, 2007

(51) Int. Cl.
*A63B 22/00* (2006.01)

(52) U.S. Cl. ..... 482/70; 482/51

(58) Field of Classification Search ..... 482/51, 482/70–71, 79–80; 36/122
See application file for complete search history.

(56) References Cited

U.S. PATENT DOCUMENTS

| | | | | |
|---|---|---|---|---|
| 2,984,497 | A * | 5/1961 | Hagen | 280/619 |
| 3,907,320 | A * | 9/1975 | Charneck | 280/818 |
| 3,933,353 | A * | 1/1976 | Marsh | 482/51 |
| 4,146,251 | A * | 3/1979 | Tanahashi | 280/610 |
| 4,275,904 | A * | 6/1981 | Pedersen | 280/818 |
| 4,784,233 | A * | 11/1988 | Favors | 280/14.25 |
| 5,181,332 | A * | 1/1993 | Uren et al. | 36/114 |
| 5,213,355 | A * | 5/1993 | Juhasz | 280/602 |
| 5,301,965 | A * | 4/1994 | Floreani | 280/600 |
| 7,159,875 | B2 * | 1/2007 | Seymour | 280/14.21 |

OTHER PUBLICATIONS

Unknown Author; no title or date: pictures showing smooshing, one indicating the picture is from 1996; Internet accessed Jul. 18, 2006.
Marina Bonello; dated May 5, 2000; Email titled "Homemade Buddy Walkers;" Internet accessed Jul. 18, 2006.
Unknown Author; Dec. 21, 2004; untitle; Internet accessed Jul. 18, 2006.
Richiro Mashima; "Play Station 2"; advertisement; Internet accessed Jul. 18, 2006.
Unknown Author; "Ski Dating";Internet accessed Jul. 18, 2006.
Unknown Author; "Wild On Park City," no date; Internet accessed Jul. 18, 2006.
Unknown Author; "Jan Lesak a Marin Bauer"; no date; Internet accessed Jul. 18, 2006.
Unknown Author; "Camp Cataraqui"; Jan. 2002; Internet accessed Jul. 18, 2006.
Unknown Author; "Icefest;" Jan. 2005(?) ; Internet accessed Jul. 18, 2006.
Palos Sports; "Foam Gym Skis"; undated ; Internet accessed Jul. 18, 2006.
Unknown Author; "Tandem Skiing—Helsinki"; undated; Internet accessed Jul. 18, 2006.

(Continued)

*Primary Examiner*—Fenn C. Mathew
(74) *Attorney, Agent, or Firm*—IP & Internet Law North, LLC; Thomas Lizzi, Esq.

(57) ABSTRACT

Trekkers for group use are disclosed. Each trekker has a plurality of foot securing devices and may have connectors at its ends for connecting the trekker in tandem with another trekker. Methods of using the trekkers are also disclosed. The methods include ways of using the trekkers in tandem and in arrays.

17 Claims, 6 Drawing Sheets

OTHER PUBLICATIONS

Unknown Author; no title or date; Hidden Valley article; Internet accessed Jul. 18, 2006.
Unknown Author; no title or date; Internet accessed Jul. 18, 2006.
Unknown Author; "Buddy Walkers and Team Walkers"; undated; Internet accessed Jul. 18, 2006.
Unknown Author; "Buddy Walkers"; Mar. 28, 2003; Internet accessed Jul. 18, 2006.
Morely Athletic Supply Co., Inc.; "Foam Gym Skis for Four"; undated; Internet accessed Jul. 18, 2006.
Learn NC; "Winter Olympics: What a Blast!"; 2001; Internet accessed Jul. 18, 2006.
Unknown Author; "Tandem Ski Event"; undated; Internet accessed Jul. 18, 2006.
USPTO; Tess record for mark "Buddy Walkers"; Jul. 27, 2006; Internet accessed Jul. 28, 2006.
Unknown Author; "Lookout Pass"; 2005-2006; Internet accessed Jul. 18, 2006.
"The Crucible," video tape, copyright 1997, produced by Good-To-Go-Video, Steve Cooney (director and producer).
Cranberry Journal Star newspaper clipping, p. 3, published between 2001 and 2003, published by Gateway Newspapers, Wexford, PA 15090.
Declaration of Philip F. Stebler, Jr.

* cited by examiner

TEAM TREKKING DEVICE AND METHODS OF USING SAME

BACKGROUND OF THE INVENTION

1. Field of the Invention

The present invention relates to recreational apparatuses that are jointly used by a plurality of individuals. More particularly, the present invention relates to trekking devices that are jointly operated by a team of two or more individuals. The present invention also relates to methods of using team trekking devices.

2. Description of the Related Art

Team sports are enjoyed worldwide. They are invigorating, foster a sense of community and common purpose, and include an element of coordinated group action. They may be engaged in for recreation, for exercise, or as a means of developing a team spirit among a group of individuals.

Among such sports are those which require coordinated group locomotion. One such sport involves a group of individuals who stand astride the tops of two parallel pieces of lumber. Each individual holds onto two ropes that are attached to the lumber pieces. One of the ropes is attached to the lumber piece that is beneath the individual's right foot and the other rope is attached to the lumber piece that is beneath the individual's left foot. Upon a signal, each individual lifts up on the rope in his or her right hand as the individual steps forward with his or her right foot. This lifts and advances the right side lumber piece a step. The group then repeats the action for the left side lumber piece. By such coordinated efforts, the group is able to achieve controlled locomotion. Although such prior art team trekking devices have been used for decades, the need to make the devices safer and easier to use has gone unrecognized and unsatisfied.

One prior art team trekking device was developed by the inventor of the present invention. That prior art trekking device consisted of a pair of 2"×6"×8 foot long pieces of lumber each of which had wrapped around and nailed to it three bicycle inner tubes that acted as foot restraints. That device was operated by a group of three individuals, each of whom slid his or her right foot under between one of the inner tubes and the top side of one of the pieces of lumber and his or her left foot between a corresponding inner tube on the top side of the other piece of lumber. Group locomotion was achieved by moving the group moving their feet in coordination. However, that device had several drawbacks. One such drawback was that the inner tube wrapping around the bottom would tear after a relatively short period of use and was also prone to marking hard surfaces traversed. Another drawback was that the rubber of inner tubes tended to twist when the piece of lumber to which it was attached was turned or when one person fell out of coordination with the group as to the direction and/or timing of his or her motions. This compromised the controllability of the team trekking device and tended to cause the users to fall, giving rise to the danger twisted ankles and other injuries.

SUMMARY OF THE INVENTION

The present invention improves upon the prior art team trekking devices. The improvements make the device embodiments of the present invention safer and easier to use than those of the prior art. In such embodiments, the team trekking devices comprise individual lengths of a durable material, each individual length having attached to it a plurality of foot securing devices spaced along its top surface. Each of the plurality of foot securing devices is constructed so as to maintain the alignment of the user's foot with the length of durable material to which it is attached and thus minimize twisting of the foot relative to the length of durable material. Each such trekking device is hereinafter identified by the word "trekker." A set of two trekkers is hereinafter identified as a "pair of trekkers."

In some preferred embodiments of the present invention, a trekker also comprises a connecting device which enables the trekker to be connected in tandem to another trekker. The trekkers of some preferred embodiments of the present invention comprise a means for selectively adjusting the weight of the trekker. Some embodiments of the present invention include a means for adapting the bottom surface of the trekker to make it compatible with the surface that is to be traversed.

The present invention also includes methods of using the team trekking devices of the present invention. In some such method embodiments, the two trekkers of a pair of trekkers are laid parallel to one another on the ground or other surface to be traversed and each individual of a group releasably engages his or her right foot into a foot securing device of the right trekker and his or her left foot into a foot securing device of the left trekker. The group steps off on the same foot moving one of the trekkers in a chosen direction. The group then steps off with the other foot moving the other trekker in a chosen direction. The group continues such coordinated movements to achieve group locomotion.

Other methods of the present invention involve the use of three or more trekkers. Some of these embodiments comprise connecting a pair of trekkers in tandem to another pair or pairs of trekkers. One or more individuals of the group may mount each pair of trekkers. All individuals of the group coordinate their movements of the trekkers to achieve group locomotion.

In some method embodiments of the present invention involving the use of three or more trekkers, the trekkers are laid out in an array wherein three or more individual trekkers are aligned parallel to one another. Individuals mount the trekkers so that at least one individual is astride each set of adjacent trekkers and together the individuals of the group effectively interconnect all of the trekkers into an array that moves as a segmented unit as the group achieves group locomotion.

Some method embodiments of the present invention involve the use of arrays described in the previous paragraph which include some trekkers that are connected in tandem.

BRIEF DESCRIPTION OF THE DRAWINGS

The criticality of the features and merits of the present invention will be better understood by reference to the attached drawings. It is to be understood, however, that the drawings are designed for the purpose of illustration only and not as a definition of the limits of the present invention.

FIG. 7A illustrates a first bottom surface texture.

FIG. 7B illustrates a second bottom surface texture.

FIG. 7C illustrates a third bottom surface texture.

DESCRIPTION OF PREFERRED EMBODIMENTS

In this section, some preferred embodiments of the present invention are described in detail sufficient for one skilled in the art to practice the present invention. It is to be understood, however, that the fact that a limited number of preferred embodiments are described herein does not in any way limit the scope of the present invention as set forth in the appended claims.

Figure 1:
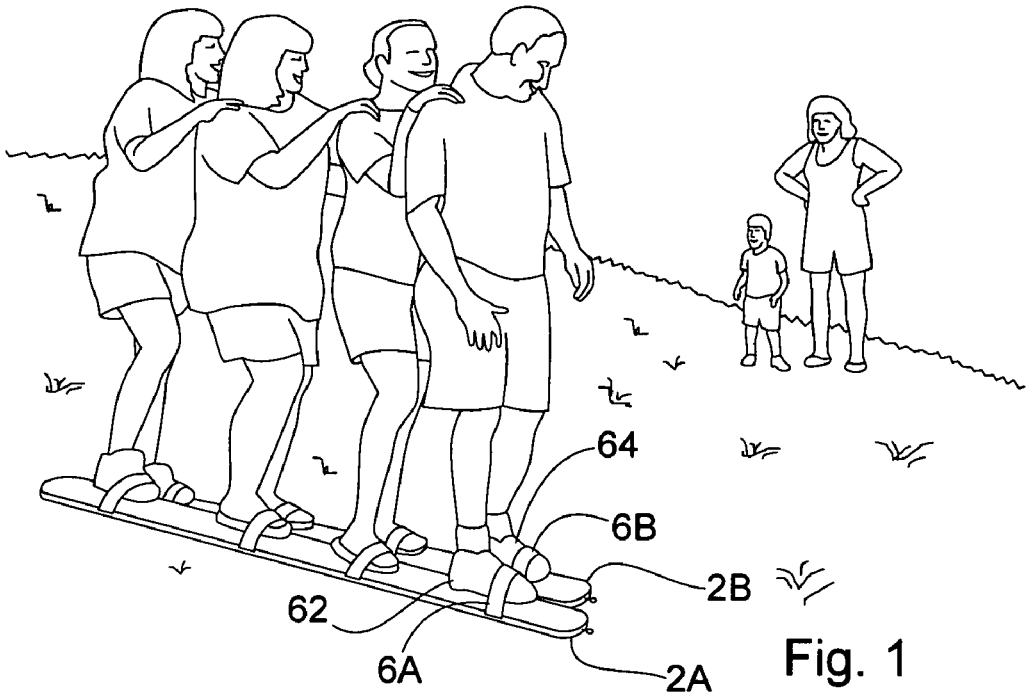
FIG. 1 is a perspective view of a group of four individuals achieving group locomotion upon a pair of trekkers in accordance with the present invention.
Figure 2:
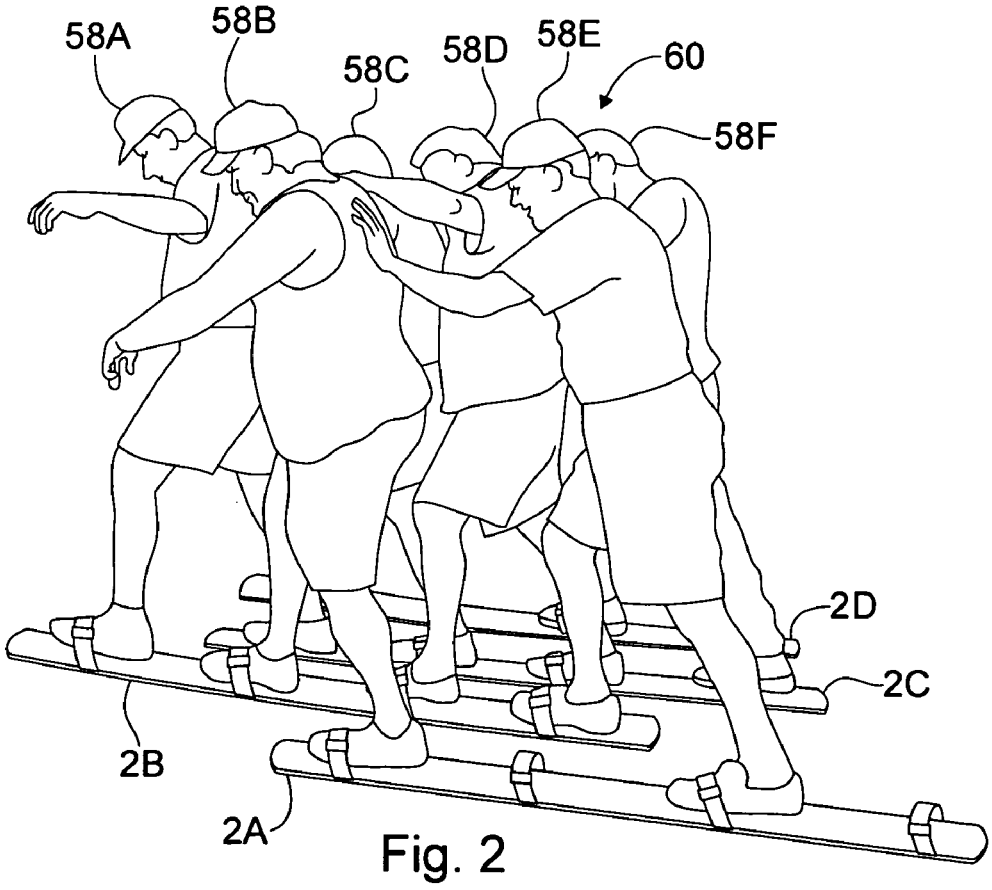
FIG. 2 is a perspective view of a group of six individuals achieving group locomotion upon two pairs of trekkers in accordance with the present invention.
Figure 3:
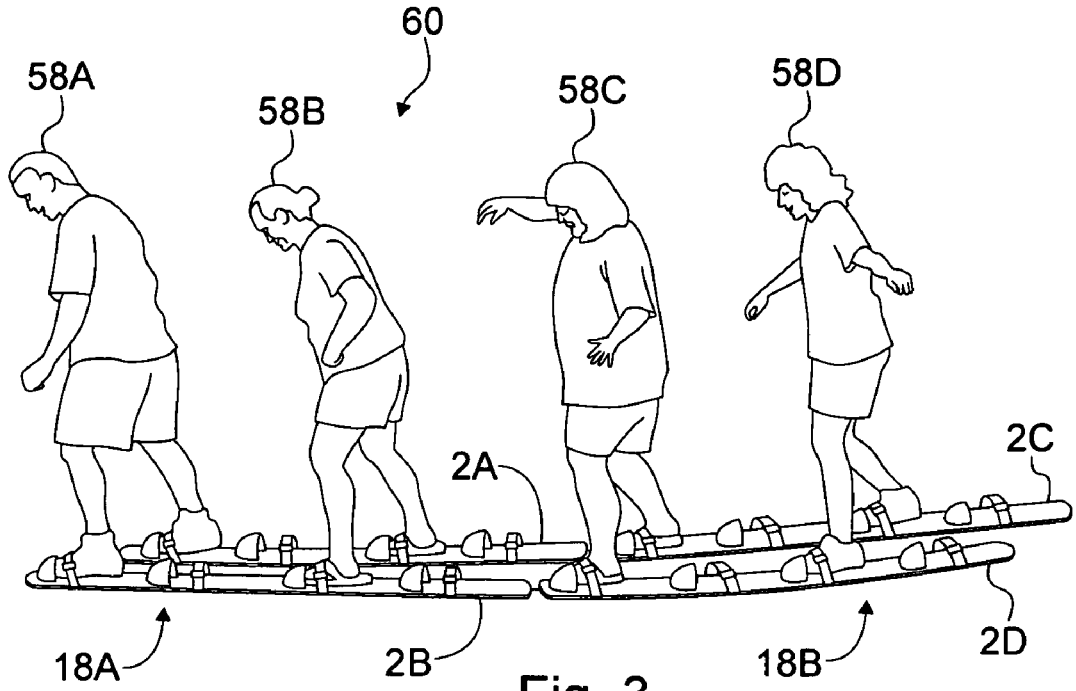
FIG. 3 is a perspective view of a group of four individuals achieving group locomotion upon two pairs of trekkers connected in tandem in accordance with the present invention.
Figure 4:
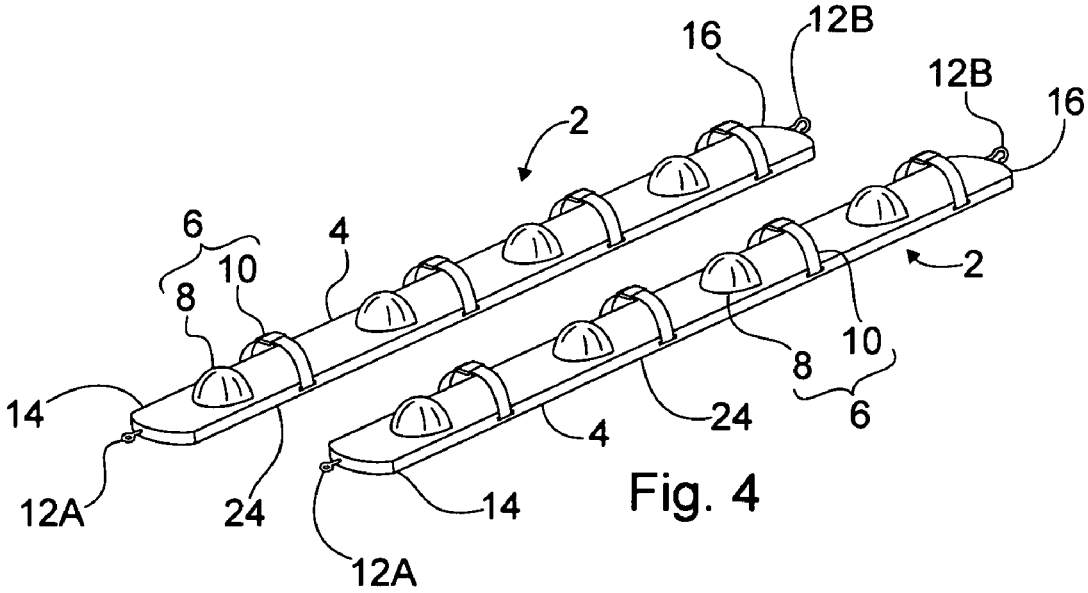
FIG. 4 is a perspective view of a pair of trekkers in accordance with the present invention.

FIGS. 1-3 illustrate one or more pairs of trekkers according to the present invention in use by groups of individuals. FIG. 4 shows a preferred embodiment of a pair of trekkers according to the present invention. Referring to FIG. 4, each trekker 2 of the shown embodiment comprises a plank-like base member 4 and a plurality of foot securing devices 6. The base member 4 is preferably wider than the foot width of the intended users. More preferably, the width of the base member 4 is about five inches. Preferably, the thickness of the base member 4 is substantially less than the width of the base member. More preferably, the thickness of the base member 4 is in the range of about one half inch to about two inches and most preferably in the range of about one inch to about one and one half inches. The foot securing devices 6 are spaced along the length of base member 4. Preferably, the length of the base member 4 is sufficient to place each intended user within arms reach of the individual in front of him or her and provides about six to twelve inches, more preferably about nine inches, between the ends of the base member 4 and the ends of first and last foot securing devices.

In the embodiment shown in FIG. 4, each of the foot securing devices 6 includes a toe restraint 8 and a tarsal or metatarsal restraint 10. More preferably, the foot securing devices 6 are spaced in the range of about fifteen to eighteen inches from one another. The toe restraint 8 is preferably positionable to accommodate the size of user's foot. The tarsal and/or metatarsal restraint 10 is likewise preferably positionable to accommodate the size of the user's foot. The tarsal and/or metatarsal restraint 10 is also preferably adjustable in length to accommodate the size of the user's foot.

Figure 5:
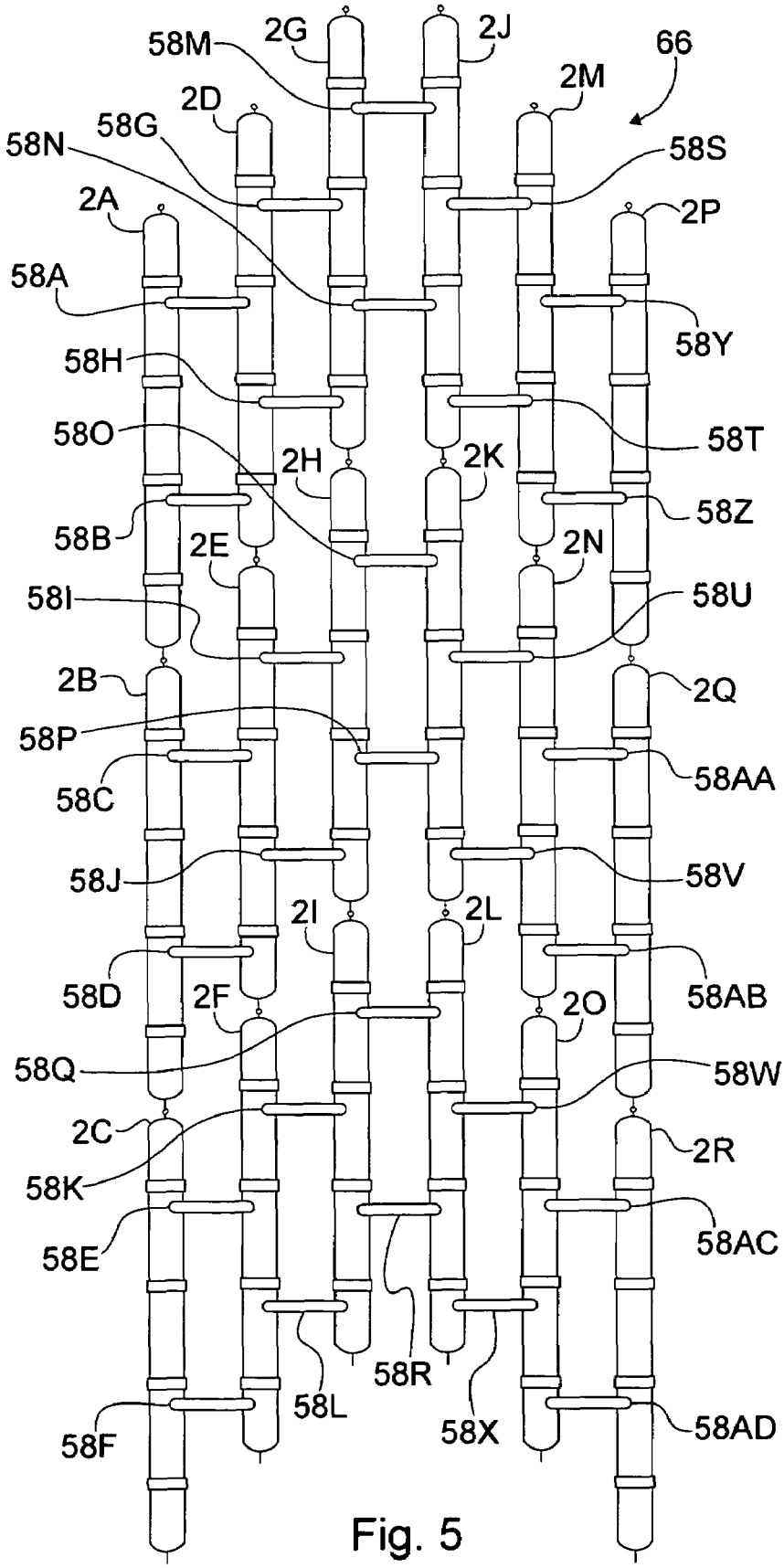
FIG. 5 is a schematic of a plan view of an array of eighteen trekkers in accordance with the present invention.

A trekker according to the present invention optionally comprises a connector at each of its ends. For example, each trekker 2 shown in FIG. 4 also has a connector 12A at the front end 14 of its base member 4 and another connector 12B at its rear end 16. The connectors 12A, 12B enable the trekkers to be connected in tandem with other trekkers. FIG. 3 illustrates trekkers 2A, 2B of a first pair of trekkers 18A connected in tandem with, respectively, trekkers 2C, 2D of a second pair of trekkers 18B. FIG. 5 also illustrates the concept of connecting trekkers in tandem. Each connector includes an anchor portion that is attached to the end of the trekker and a extension that is adapted to connect with a corresponding extension portion of a connector of another trekker or to an intermediate structure, for example a section of chain, cable, or rope, that in turn connects to the connector of another trekker. Preferably, the connectors releaseably connect one trekker to another. Examples of releasable connectors are the eye 20 and hook 22 connectors shown in FIGS. 6A and 6B.

Referring again to FIG. 4, the front end 14 of each base member 4 is shown to be rounded as is the rear end 16 of each base member 4. Such rounding is preferred because it enhances the ability of two trekkers connected in tandem to rotate out of planar alignment with one another for negotiating turns. However, the present invention is not limited to embodiments having rounded ends. Rather, trekkers according to the present invention may have ends of any configuration, including square cut.

Figure 7A:
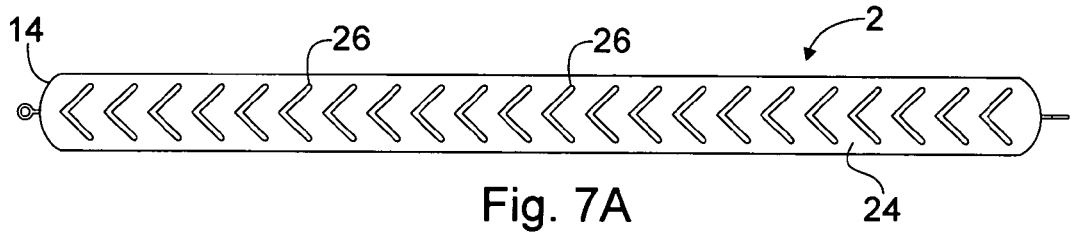
FIGS. 7A-C are plan views of bottoms of trekkers according to embodiments of the present invention.
Figure 7B:
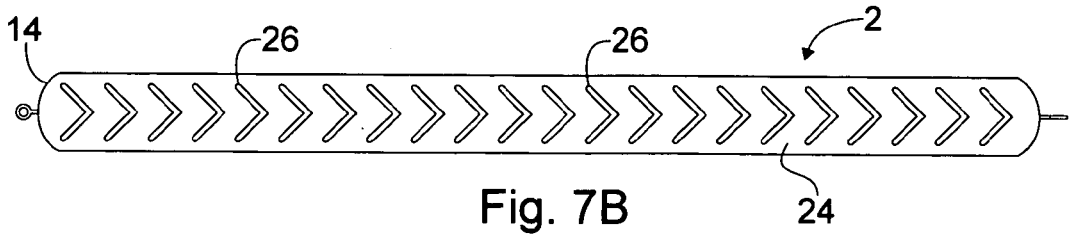
Figure 7C:
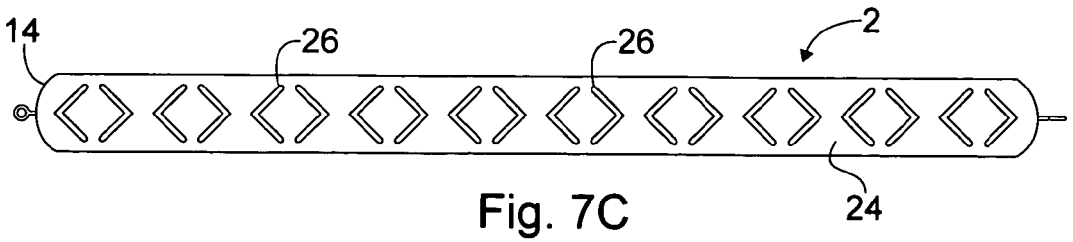

Each of the trekkers 2 shown in FIG. 4 also has a bottom surface 24 that contacts the ground or other surface that is to be traversed. The bottom surface 24 is preferably adapted to be compatible with the surface that is to be traversed. Thus, the bottom surface 24 may be flat or textured or otherwise configured to provide the traction necessary to achieve controllable locomotion. FIGS. 7A-C show examples of textured bottom surfaces 24. In each of these examples, the texture consists of chevrons 26 and their orientation with respect to the front end 14 of the trekker 2. Such chevrons, or other texture features, may be raised above or recessed into the surrounding area of bottom surface 24. Textures comprising other tread designs are also within the contemplation of the present invention. The texture is selected such that it provides the traction necessary for locomotion across the surface to be traversed.

The bottom surface 24 is also preferably adapted to avoid damaging the surface to be traversed. For example, referring to FIG. 6B, which shows a side view of the base member 4 of a trekker according to an embodiment of the present invention, there is illustrated a pad 28 attached to the bottom surface 24 of the base member 4. Such a pad 28 can be continuous or non-continuous, flat or textured, so long as it covers sufficient portions of the bottom surface 24 to achieve the purpose of preventing substantial damage to the surface that is to be traversed. Also, such pads 28 can be fixedly attached, for example, by a permanent adhesive or fastener, or removable attached, for example by a non-permanent adhesive or fastener. In this specification and the accompanying claims, the terms "permanent" and "permanently" are to be construed as meaning "intended to remain substantially unchanged during the expected useful lifetime of the trekker." Preferably, the material of construction of the base member is selected so that no padding is needed to prevent damage to the types of traversing surfaces that the trekker is expected to be used upon.

The present invention contemplates that any type of foot securing device may be used as part of a trekker so long as it provides the user's foot the degree of attachment and the flexibility of movement that is necessary to controllably move the trekker while keeping the user's foot in substantial alignment with the longitudinal axis of the trekker. A foot securing device may consist of a simple continuous loop or band of material as depicted by foot securing device 6A, 6B in FIG. 1. Examples of materials for such loops or bands of leather, plastic, metals, and woven belts or straps. A foot securing device 6 may consist of an adjustable strap as shown by foot securing device 6 in FIG. 2. Such adjustable straps may be fastened by buckles, hook and loop fasteners, slideable strap restraints, quick-release fasteners, interference fit connectors or snaps, zippers, knots, or other types of releasable fasteners known to those skilled in the art. Foot securing devices may consist of a combination of a toe restraint 8 and a tarsal and/or metatarsal restraint 10 as shown in FIGS. 3 and 4. Where a toe restraint 8 is employed, it is preferred that the toe restraint 8 be positionable laterally and/or longitudinally to accommodate the size of the user's foot. The tightness with which the toe restraint 8 secures the user's foot may be adjustable, for example, as where the toe restraint 8 consists of an adjustable or elastomeric strap.

Figure 6A:
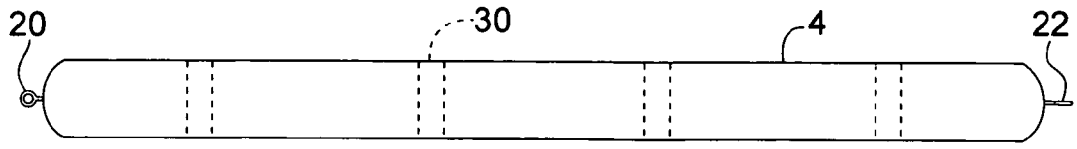
FIG. 6A is a plan view of a base member of an embodiment of a trekker in accordance with the present invention.
Figure 6B:
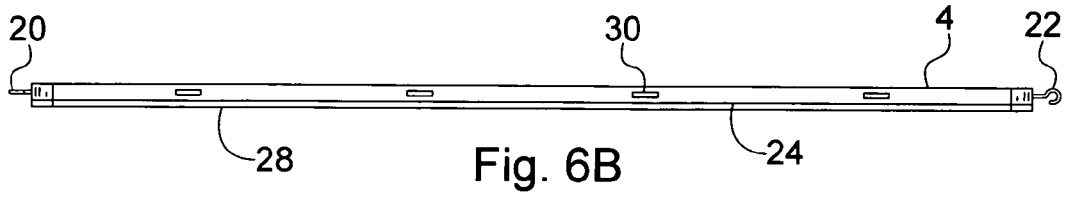
FIG. 6B is a side view of the base member illustrated in FIG. 6A.
Figure 8:
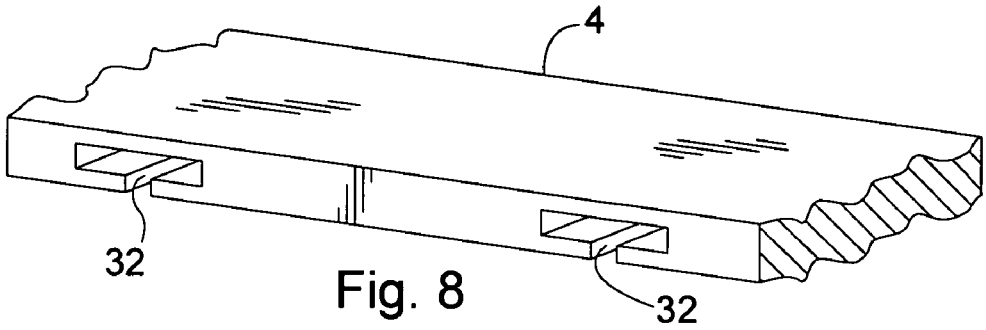
FIG. 8 is a perspective view of a portion of base member of a trekker according to an embodiment of the present invention which illustrates grooves therein for securing foot securing devices thereto.

A foot securing device may be secured to the base member of the trekker by any means that allows it to perform its function. Thus, a foot securing device, or a component portion thereof, may be attached to the top or side surface of the base member of the trekker by, for example, an adhesive, screws, bolts, nails, staples, clamps, screw anchored metal plates, interference fit connectors or snaps, zippers, hook and loop fasteners, or other fasteners. A foot securing device may also be secured to the base member of a trekker by passing a portion of it through a groove or channel in the base member. For example, FIGS. 6A and 6B show examples of channels 30 through which belt-type foot securing devices may be secured to the base member 4. FIG. 8 shows an example of a groove 32 which may be used for securing a belt-type foot securing device to the base member 4.

In some embodiments of the present invention, the number and the relative positions of the foot securing devices on the base member are permanently fixed. In such embodiments, the foot securing devices are preferably evenly spaced from one another and that the spacing distance be within the arm's length of an intended average user. For example, FIG. 4 shows such an embodiment in which each trekker 2 has four foot securing devices 6.

Figure 9:
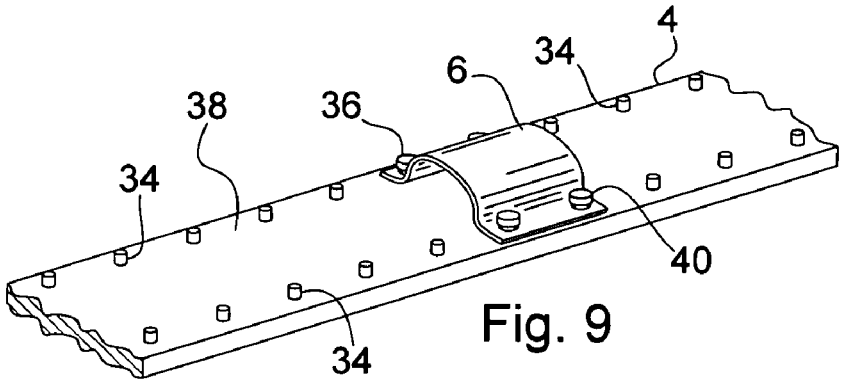
FIG. 9 is a perspective view of a portion of a trekker according to an embodiment of the present invention which illustrates a first arrangement of fasteners for selectively securing a foot securing device to the trekker.

The present invention also contemplates embodiments in which the number and/or the relative position of the foot securing devices are selectively variable. For example, FIG. 9 shows such an embodiment. Referring to FIG. 9, the base member 4 of trekker 2 has a plurality of posts 34 adapted to receive corresponding clips 36 of a foot securing device 6 so as to removably secure the foot securing device 6 to the base member 4 at any desired position along the length of base member 4. Although such posts 34 are shown in FIG. 9 as being located on the top surface 38 of base member 4, they could be located on the longitudinal sides of base member 4.

Figure 10:
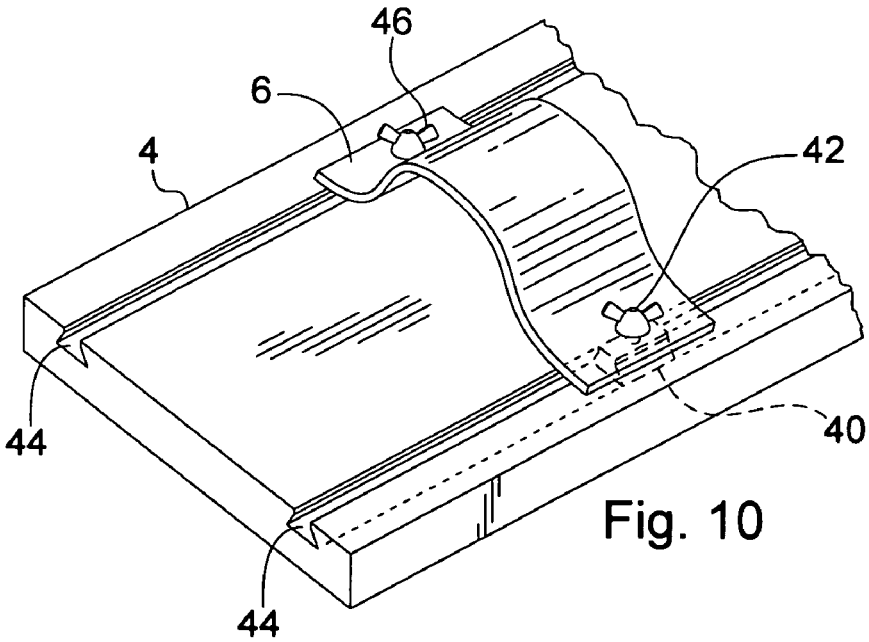
FIG. 10 is a perspective view of a portion of a trekker according to an embodiment of the present invention which illustrates a second arrangement of fasteners for selectively securing a foot securing device to the trekker.

Referring to FIG. 10, another embodiment of the present invention in which the number and/or relative position of the foot securing devices is selectively variable is illustrated. In this embodiment, the base member 4 is provided with two longitudinal dove-tail slots 40. The tab portions 42 of dove-tailed fastener 44 of the foot securing device 6 are slidably insertable into the slots 40 of the base member 4. Once the foot securing device 6 has been moved to the desired position along the length of the base member 4 the clamping mechanism 46 of each dove-tailed fastener 44 is engaged to secure the foot securing device 6 to the base member 4.

The base members of trekkers according to the present invention are preferably constructed of a durable material. Examples of such materials include plastics, polymers, fiberglass, rubbers, vinyls, Plexiglas, structural foams, composite materials, metallic materials, and wood. The material may be homogeneous or non-homogeneous. Examples of non-homogeneous base member materials include laminates of different materials, such as laminates of fiberglass and plastic, and coated materials, such as an aluminum core coated with a polymer.

The weight of each trekker is preferably in the range of between one and twenty pounds and more preferably in the range of five to eight pounds.

Figure 11:
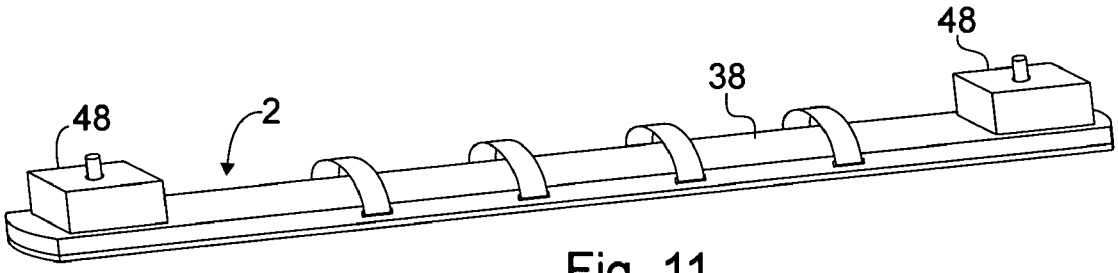
FIG. 11 is a perspective view of a trekker according to an embodiment of the present invention which illustrates a first arrangement for selectively varying the weight of the trekker.

The present invention also includes embodiments in which the weight of each trekker is selectively variable. Such weight variability may be achieved, for example, by securing weights 48 to the top surface 38 of a trekker 2 as shown in FIG. 11.

Figure 12:
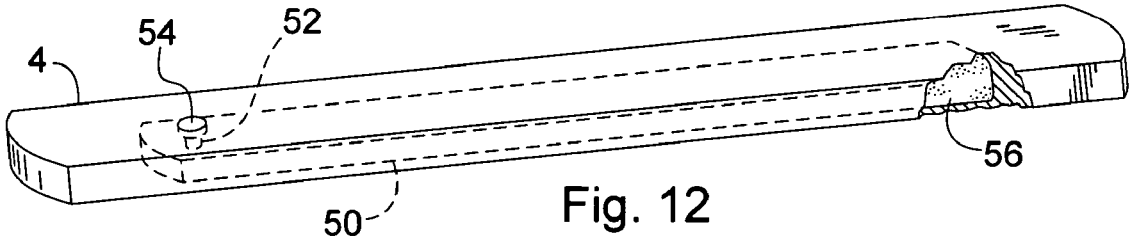
FIG. 12 is a perspective view of a trekker, shown partially in cutaway and phantom, according to an embodiment of the present invention which illustrates a first arrangement for selectively varying the weight of the trekker.

Another example of how such weight variability may be achieved is by providing one or more reservoirs within the base member of the trekker which may be filled with a flowable material, for example, water or sand. FIG. 12 shows an example of such an embodiment in which base member 4 comprises reservoir 50. Reservoir 50 is filled through mouth 52 upon the removal of cap 54. Sufficient flowable material 56 is poured into reservoir 50 to adjust the weight of the trekker 2 to the desired level. The weight of the trekker 2 can thereafter be selectively reduced by pouring out some or all of the flowable material 56 from the reservoir 50.

The present invention also includes embodiments related to the use of the trekkers of the present invention. FIG. 1 illustrates one such method embodiment. In this embodiment, the two trekkers 2A, 2B of a pair of trekkers are laid parallel to one another on the ground or other surface that is to be traversed and each individual 58 of a group 60 releasably engages his or her right foot 62 into a foot securing device 6A of the right trekker 2A and his or her left foot 64 into a foot securing device 6B of the left trekker 2B. The group 60 steps off on the same foot moving one of the trekkers in a chosen direction. The group 60 then steps off with the other foot moving the other trekker in a chosen direction. The group continues such coordinated movements to achieve group locomotion.

Other methods of the present invention involve the use of more than two trekkers. The number of trekkers so employed may be either an even or odd number. In some of these embodiments, trekkers are connected in tandem with one or more other trekkers. Individuals of the group mount laterally adjacent trekkers and coordinate their movements of the trekkers to achieve group locomotion.

FIG. 2 shows an embodiment of the present invention which employs four trekkers 2A-D that are laid out in an array in which each of the trekkers 2A-D is aligned parallel to one another. In this embodiment, the group 60 consists of six individuals 58A-F. Individual 58A is astride trekkers 2B, 2C. Individual 58B is astride trekkers 2A, 2B. Individual 58C is astride trekkers 2C, 2D. Individual 58D is astride trekkers 2B, 2C. Individual 58E is astride trekkers 2A, 2B. Individual 58F is astride trekkers 2C, 2D. Thus, individuals

58A-E of group 60 have mounted the trekkers 2A-D so that at least one individual is astride each set of laterally adjacent trekkers and together the individuals of the group 60 effectively interconnect all of the trekkers 2A-D into an array that moves as a segmented unit as the group 60 achieves group locomotion.

FIG. 3 shows an embodiment of the present invention which employs two pairs of trekkers connected in tandem. First pair 18A consists of trekkers 2A, 2B and second pair 18B consists of trekkers 2C, 2D. Trekker 2A is connected in tandem with trekker 2C and trekker 2B is connected in tandem with trekker 2D. In this method embodiment, each of the individuals 58A-D of group 60 mounts a pair of trekkers. Thus, individuals 58A, 58B are astride trekkers 2A, 2B and individuals 58C, 58D are astride trekkers 2C, 2D. By coordinating their movements, individuals 58A-D are able to achieve group locomotion.

FIG. 5 illustrates schematically an arrangement of trekkers and individuals in a method embodiment which involves more than two trekkers arranged in parallel and in tandem. Referring to FIG. 5, array 66 of trekkers includes eighteen trekkers 2A-R. Some of the trekkers are connected in tandem, for example trekkers 2A-C. Each set of adjacent trekkers, for example trekkers 2D, 2G is spanned two of the thirty individuals of the group, for example, individuals 58G, 56H, thus interconnecting all of the trekkers 2A-R of array 66. By mounting the trekkers 2A-R and coordinating their actions, individuals 58A-AD achieve group locomotion.

Method embodiments of the present invention also include embodiments in which multiple groups mounted upon trekkers of the present invention simultaneously compete against one another in tests of group locomotive skill and/or speed.

The method embodiments of the present invention may be performed inside or outside. Such embodiments include circumstances ranging from impromptu uses to highly organized uses. The present invention contemplates recreational uses at family, living group, company, or other organization picnics, outings, or events. The present invention also contemplates uses in organized track and field event competitions in schools or the Olympics or by professional teams. The method embodiments of the present invention may be used to promote the teaching of teamwork, coordination, endurance, stamina, confidence, exercise, determination, or the attainment of a sense of accomplishment.

While only a few embodiments of the present invention have been shown and described, it will be obvious to those skilled in the art that many changes and modifications may be made thereunto without departing from the spirit and scope of the present invention as described in the following claims.

What is claimed is:

1. An apparatus comprising a pair of trekkers, each trekker having;

a) a base member, said base member having a plank-like shape and a width sufficient to accommodate a user's foot width and a length sufficient to accommodate a plurality of users and a horizontally-flat front end and a horizontally-flat rear end;

b) a plurality of foot securing devices, wherein each of said foot securing devices is constructed so as to maintain a user's foot in substantial alignment with the longitudinal axis of said trekker; and c) a connector attached to said front end and a complementary connector attached to said rear end for connecting the front end of one trekker of said pair of trekkers to the rear end of the other trekker of said pair of trekkers so as to enable said one trekker and said other trekker to be used in tandem.

2. The apparatus of claim 1, wherein said plurality of foot securing devices includes at least three foot securing devices.

3. The apparatus of claim 2, wherein one of the foot securing devices is substantially the same distance from each of two other of the foot securing devices.

4. The apparatus of claim 1, wherein at least one of said plurality of foot securing devices includes a means to adjustably secure a user's foot to said base member.

5. The apparatus of claim 4, wherein said means includes at least one selected from the group consisting of a buckle, a hook and loop fastener, and a slideable strap restraint.

6. The apparatus of claim 1, wherein at least one of said plurality of foot securing devices includes at least one selected from the group consisting of a tarsal restraint and a metatarsal restraint.

7. The apparatus of claim 1, wherein at least one of said plurality of foot securing devices includes a toe restraint.

8. The apparatus of claim 1, wherein at least one of said plurality of foot securing devices is selectively positionable along the length of said base member.

9. The apparatus of claim 1, wherein at least one of said front and rear ends is rounded.

10. The apparatus of claim 1, wherein said complementary connector is selected from the group consisting of an eye and a hook.

11. The apparatus of claim 1, wherein said base member comprises a material that prevents use of the trekker from substantially damaging a surface that is to be traversed by the trekker.

12. The apparatus of claim 1, wherein said base member has a textured bottom surface.

13. The apparatus of claim 1, further comprising a pad attached to the bottom surface of said base member.

14. The apparatus of claim 1, wherein said base member includes a reservoir.

15. The apparatus of claim 1, further comprising weights attachable to the top surface of said base member.

16. The apparatus of claim 1, wherein said base member comprises a homogeneous material.

17. The apparatus of claim 1, wherein said base member comprises a non-homogeneous material.

* * * * *